United States Patent [19]

Ramm

[11] 4,257,749

[45] Mar. 24, 1981

[54] LIQUID RING COMPRESSOR OR VACUUM PUMP

[75] Inventor: Claus Ramm, Berlin, Fed. Rep. of Germany

[73] Assignee: Siemens Aktiengesellschaft, Berlin and Munich, Fed. Rep. of Germany

[21] Appl. No.: 69,992

[22] Filed: Aug. 27, 1979

[30] Foreign Application Priority Data

Sep. 26, 1978 [DE] Fed. Rep. of Germany ..... 2841906

[51] Int. Cl.[3] ..... F04C 19/00

[52] U.S. Cl. ..... 417/68

[58] Field of Search ..... 417/68, 69, 313

[56] References Cited

U.S. PATENT DOCUMENTS 4,057,368 11/1977 Balling ..... 417/313

4,087,208 5/1978 Uda et al. ..... 417/68 X

FOREIGN PATENT DOCUMENTS 2731451 7/1977 Fed. Rep. of Germany ..... 417/68

*Primary Examiner*—Carlton R. Croyle

*Assistant Examiner*—Edward Look

*Attorney, Agent, or Firm*—Kenyon & Kenyon

[57] ABSTRACT

In a liquid ring compressor or vacuum pump with a liquid cooled electric motor and in a liquid separator disposed in housings which are connected to each other without piping and are subdivided into chambers by partitions, the compressor or pump housing forms, together with the motor housing, a first housing block and, in a second housing block, which is connected to the first via internal canals, a heat exchanger and the liquid separator are arranged with the two prismatic housing blocks immediately adjacent and sealed to each other on one side. The inlets and outlets for the liquid to be pumped and the cooling liquid are distributed over both housing blocks to provide a closed circuit for the operating liquid and for a continuous external supply of cooling liquid.

2 Claims, 2 Drawing Figures

LIQUID RING COMPRESSOR OR VACUUM PUMP

BACKGROUND OF THE INVENTION

This invention relates to liquid ring compressors or vacuum pumps in general and more particularly to an improved housing design for such pumps and compressors.

A liquid ring compressor or vacuum pump with a liquid cooled electric motor for driving the impeller, as well as a liquid separator, wherein the individual components are arranged in adjoining housings which are divided into chambers by partition and in which the housings are connected to each other without piping and sealed to the outside to form a unit which has only four external connections which comprise a gas inlet and outlet and a liquid inlet and outlet, is described in German Auslegeschrift No. 27 31 451.

In the known arrangement, the liquid separator is part of a distributor for gas and operating liquid, designed as the motor housing; its size and spatial relation to the impeller is therefore fixed. In addition, the connections for gas and operating liquid are concentrated at the distributor, so that certain placement and installation problems can result, in running the external piping, and because all parts extend in the direction of the motor shaft. In addition, the size and shape of the liquid separator is made relatively small, so that it is not suitable as a storage tank and for accommodating a heat exchanger, which would be necessary for applications where the operating liquid is recirculated.

SUMMARY OF THE INVENTION

It is therefore an object of the present invention to provide a unit of the type mentioned at the outset, in which: (a) a separator, cooling and storage container the size of which is not limited as to size, can be interchangeably connected; (b) the connection possibilities for the gas and the operating liquid can be varied, dispensing with a distributor integral with the motor housing; (c) the length of the unit in the direction of the motor shaft can be determined solely by the housing for the compressor or the vacuum pump and the size of the motor, and (d) the operating liquid can be recirculated.

These objects are accomplished in accordance with the present invention through the use of a first housing containing the liquid ring compressor, or vacuum pump, and the liquid cooled electric motor. The first housing has an external gas inlet connected to the suction side of the pump and an external cooling liquid outlet. The first housing has a plain outer side with first, second and third connecting opening for gas and liquid. A second housing is provided containing a liquid separator designed as a cooling and storage container and a heat exchanger for the operating liquid. The second housing has a gas outlet connected to the outlet of the liquid separator and an external cooling liquid inlet. The second housing has a plain outer side, with connection openings for gas and liquid, matching those of the first housing. The first and second housings are in abutting relationship with the openings aligned and with sealing means therebetween. Both of the housing blocks contain first, second and third canals formed by internal walls. The first canals connect the cooling liquid inlet through the heat exchanger for the operating liquid, through the first connecting opening and through the heat exchanger for the electric motor to the cooling liquid outlet. The second canals connect the inlet of the liquid separator through the second connecting opening to the pressure side of the pump and the third canals connect the outlet of the liquid separator through the heat exchanger for the operating liquid and the third connecting opening to the suction side of the pump so that the canals form a closed operating liquid circuit. A particularly compact embodiment of the present invention is disclosed in which the first and second housing blocks are of prismatic shape and wherein a gas inlet and outlet are arranged on the top side and the cooling liquid inlet and outlet are arranged laterally, respectively.

DETAILED DESCRIPTION OF THE INVENTION

Figure 1:
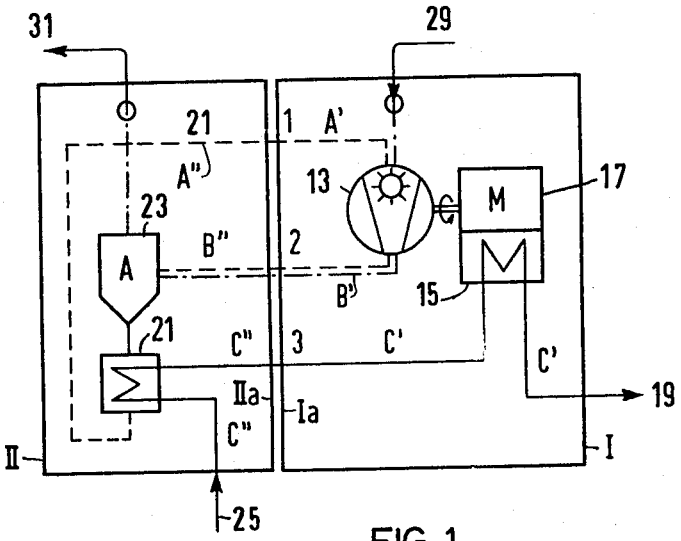
FIG. 1 is a connection diagram of the parts of the subject of the present invention.
Figure 2:
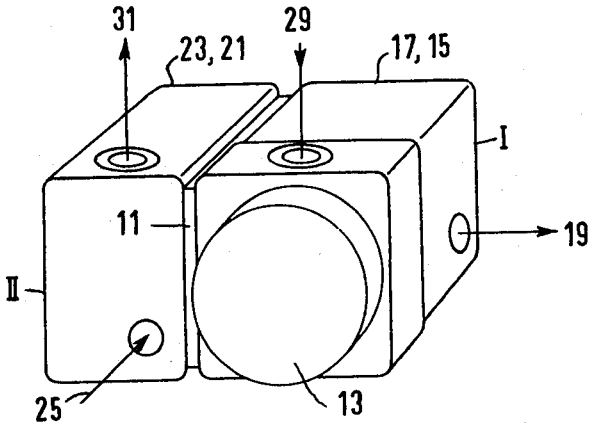
FIG. 2 is a simplified perspective view of FIG. 1.

In accordance with the present invention, two prismatic housing blocks I and II have, on their plane outer side I*a* and II*a* facing each other, coinciding connecting openings 1, 2 and 3, which are sealed with respect to the outside by a connecting gasket 11. The openings 1, 2 and 3 are in communication with canals A′, B′ and C′, defined by inside walls, in the housing block I and A″, B″, C″ in the housing block II. The canal A′ is connected to the suction side of the pump 13 and the connecting opening 1. Canal B′ is connected to the pressure side of the pump 13 (herein pump 13 refers generally to a liquid ring compressor or a vacuum pump) and the connecting opening 2. Canal C′ is connected to the connecting opening 3, a heat exchanger 15 for the electric motor 17 and continues through heat exchanger 15 to the liquid outlet 19 in the housing block I. Canal A″ is connected to the connecting opening 1 and, via a heat exchanger 21 for the operating liquid, to the outlet of the liquid separator 23. Canal B″ is connected to the connecting opening 2 and the inlet of the liquid separator 23. Canal C″ is connected to the liquid inlet 25 and through the heat exchanger 21 for the operating liquid to the connecting opening 3 in the housing block 2. The canals A′, A″ and B′, B″ close the operating liquid circuit 27, shown by dashed lines. In addition, the pump 13 is connected, on its suction side, to a gas inlet 29 in the housing block I, and the outlet of the liquid separator 23 to a gas outlet 31 in the housing block II.

The liquid inlet 25 is arranged at the end face and the gas outlet 31 on the top side of the housing block II, the liquid outlet 19 at the side wall and the gas inlet 29 on the top side of the housing block I, so that the external feed and discharge lines for the gas and the cooling liquid are not in each other's way, and the overal length of the unit is determined only by the liquid separator including the heat exchanger in the housing block II and by the pump 13 as well as the electric motor 17 including the heat exchanger 17 in the housing block I. The design of the separator and storage space 23 as well as of the heat exchanger 21 can be independent of the spatial situation of the housing block I. The plane, aligned undersides of the two housing blocks permit a simple and secure installation on a common support.

What is claimed is:

1. In a liquid ring pump with a liquid cooled electric motor for driving the impeller, as well as with a liquid separator, wherein the individual components are arranged in adjoining housing which are divided into chambers by partitions, said housings being connected to each other without piping and sealed to the outside to form a unit which has only four external connections which comprise a gas inlet and outlet and a liquid inlet and outlet, the improvement comprising:

(a) a first housing containing therein the liquid ring and the liquid cooled electric motor, said first housing having an external gas inlet connected to the suction side of the pump and an external cooling liquid outlet, said first housing having a plane outer side with first, second and third connecting openings for gas and liquid;

(b) a second housing containing a liquid separator designed as a cooling and storage container and a heat exchanger for the operating liquid, said second housing having a gas outlet connected to the outlet of the liquid separator and an external cooling liquid inlet, said second housing having a plane outerside with connecting openings for gas and liquid matching those of said first housing, said first and second housing abutting with said openings aligned and sealing means therebetween;

(c) both of said housing blocks containing first, second and third canals formed by internal walls, the respective canals being connected to each other through said connecting openings, of which the first canals connect the cooling liquid inlet through the heat exchanger for the operating liquid, the first connecting opening and the heat exchanger for the electric motor to the cooling liquid outlet, the second canals connect the inlet of the liquid separator through the second connecting opening to the pressure side of the pump and the third canals connect the outlet of the liquid separator through the heat exchanger for the operating liquid and the third connecting opening to the suction side of the pump so that the canals form a closed operating liquid circuit.

2. The improvement according to claim 1, wherein the first and second housing blocks are of prismatic shape and wherein the gas inlet and outlet are arranged on the top side, and the cooling liquid inlet and outlet are arranged laterally, respectively.

* * * * *